United States Patent [19]

Potter

[11] 4,109,629

[45] Aug. 29, 1978

[54] FUEL INJECTION PUMPING APPARATUS

[75] Inventor: James Charles Potter, London, England

[73] Assignee: C.A.V. Limited, Birmingham, England

[21] Appl. No.: 737,034

[22] Filed: Oct. 29, 1976

Related U.S. Application Data

[63] Continuation of Ser. No. 587,886, Jun. 18, 1975, abandoned, which is a continuation of Ser. No. 457,475, Apr. 1, 1974, abandoned.

[30] Foreign Application Priority Data

Apr. 1, 1974 [GB] United Kingdom ..... 16486/74

[51] Int. Cl.[2] ..... F02D 1/04

[52] U.S. Cl. ..... 123/140 R; 123/140 FG

[58] Field of Search ..... 123/140 R, 140 FG

[56] References Cited

U.S. PATENT DOCUMENTS

| | | | |
|---|---|---|---|
| 3,103,822 | 9/1963 | Mirachi | 123/140 R |
| 3,565,047 | 2/1971 | Baluas | 123/140 FG |
| 3,577,968 | 5/1971 | Staudt | 123/140 R |
| 3,613,651 | 10/1971 | Snyder | 123/140 R |
| 3,620,199 | 11/1971 | Kuhn | 123/140 R |
| 3,640,258 | 2/1972 | Isobe et al. | 123/140 FG |
| 3,698,369 | 10/1972 | Vuaille | 123/140 FG |
| 3,791,362 | 2/1974 | Nakamura et al. | 123/140 R |
| 3,884,206 | 5/1975 | Ritter | 123/140 R |
| 3,895,619 | 7/1975 | Potter | 123/140 R |

*Primary Examiner*—Charles J. Myhre
*Assistant Examiner*—David D. Reynolds
*Attorney, Agent, or Firm*—Holman & Stern

[57] ABSTRACT

A fuel injection pumping apparatus includes an injection pump having a fuel quantity control rod, the setting of which is determined by a governor mechanism; the governor mechanism includes a first pivotal link which is moved by a servo-mechanism controlled by means responsive to the speed of the associated engine; the servo-mechanism effects movement of the link about a first pivot axis; a second link is pivotally connected to the first link, and movable pivot means is disposed in a slot formed in the second link; the second link is connected to the control rod and operator adjustable means is provided for moving the pivot means to adjust the amount of fuel supplied to the engine.

6 Claims, 8 Drawing Figures

FUEL INJECTION PUMPING APPARATUS

This is a continuation of application Ser. No. 587,886 filed June 18, 1975 which in turn is a Rule 60 continuation of Ser. No. 457,475 filed April 1, 1974, both of which are now abandoned.

FIELD OF INVENTION

This invention relates to fuel injection pumping apparatus for supplying fuel to internal combustion engines and of the kind including an injection pump having an axially movable control rod for determining the amount of fuel delivered by the injection pump at each injection stroke and governor means for effecting a control of the position of the control rod.

OBJECTS AND SUMMARY OF THE INVENTION

The object of the invention is to provide such an apparatus in a simple and convenient form.

According to the invention in an apparatus of the kind specified, said governor means comprises a first pivotal link, means responsive to the speed of the associated engine for moving the link angularly about a fixed axis adjacent one end of the first link, a second pivotal link pivotally connected to the first link at a position removed from its pivotal connection with the first link, said second link being engageable with the control rod so as to effect movement thereof, a slot defined in said second link, pivot means located in said slot, and operator adjustable means for adjusting the position of said pivot means, the arrangement being such that adjustment of said operator adjustable means will effect axial movement of the contol rod, said means responsive to the speed of the associated engine acting to move the control rod to reduce the amount of fuel supplied to the engine in the event that the engine speed increases above the value set by said operator adjustable means.

One example of a fuel injection pumping apparatus in accordance with the invention will now be described with reference to the accompanying drawings in which:

DESCRIPTION OF PREFERRED EMBODIMENTS

With reference to the drawings, the apparatus comprises a pump housing 10 having an end closure 11 secured to the housing by means of bolts. The end closure 11 together with the housing 10 define a chamber 12 in which is located a governor mechanism, to be described.

Figure 3:
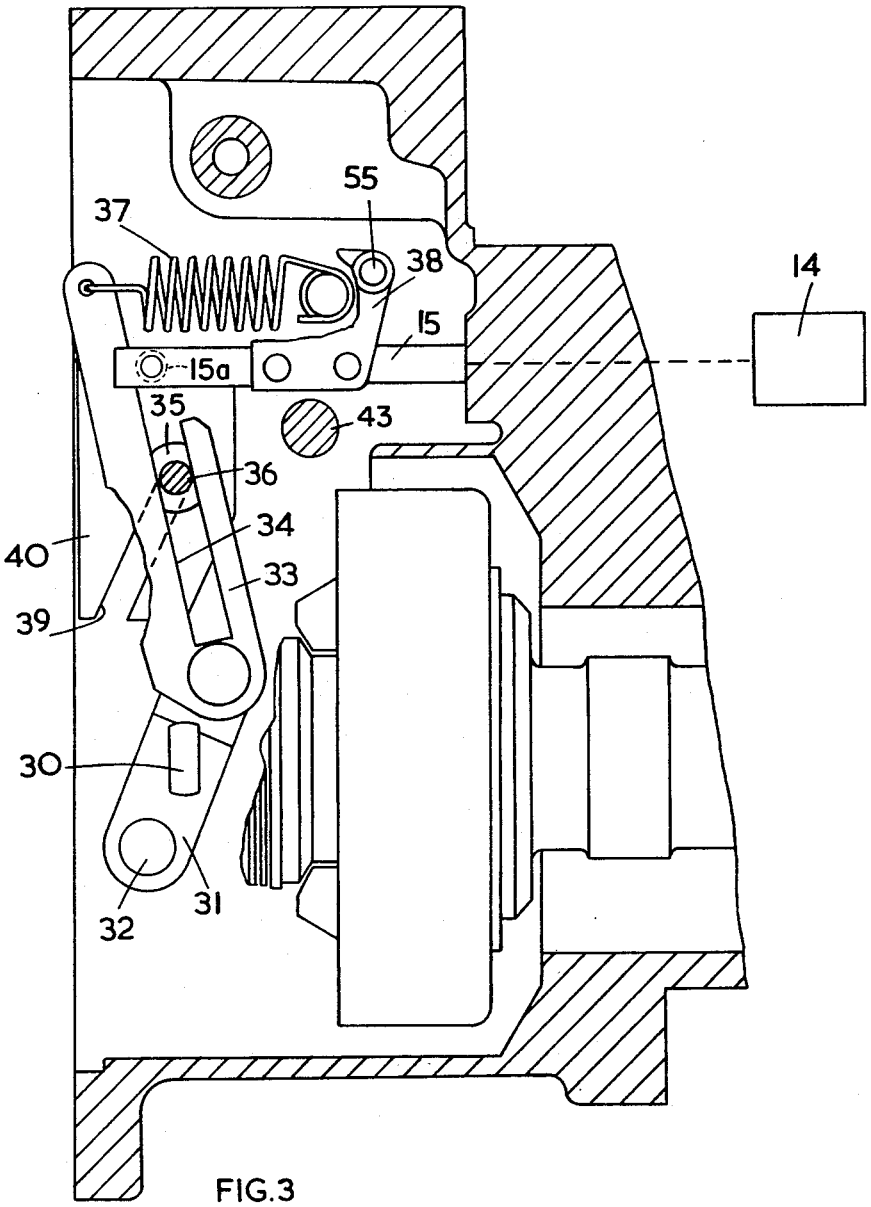
FIG. 3 is a sectional side elevation with parts removed, looking in the direction of arrow B of FIG. 1.
Figure 8:
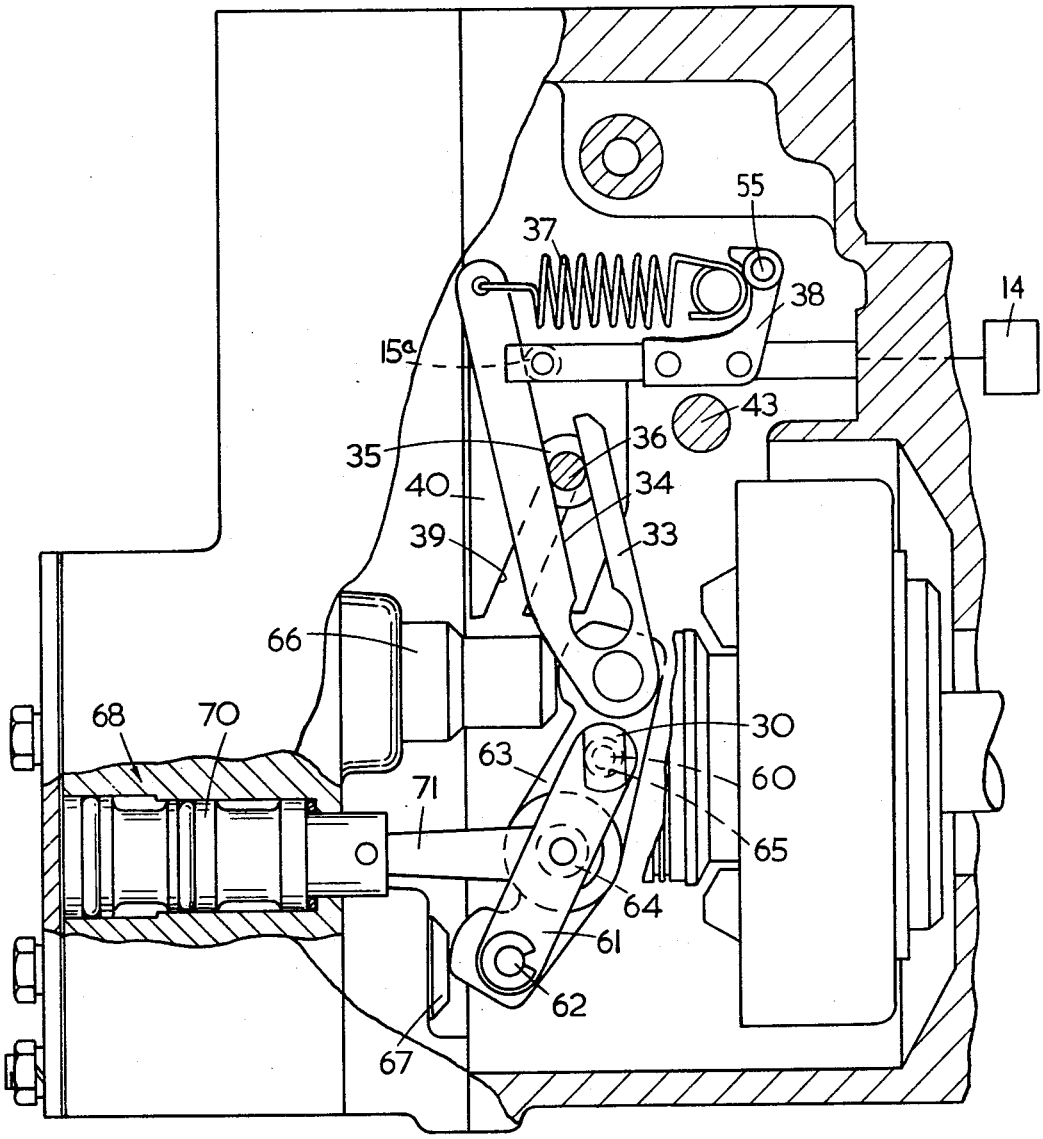
FIG. 8 is a view similar to FIG. 3 additionally showing a servo-mechanism and associated structure.

Extending through the chamber and the housing 10 is a rotary shaft 13 which within the pump housing, is provided with cams for the operation of individual injection pumps, these pumps being collectively indicated at 14 in FIGS. 3 and 8. The shaft 13 extends through the end closure and in use, is driven in timed relationship with an associated engine.

The quantity of fuel supplied at each injection stroke is determined by a fuel control rod 15 which is axially movable within the housing 10, and which projects into the chamber 12.

The shaft 13 carries a speed responsive means 16 and this includes a cup shaped member 17 in which are located a plurality of governor weights 18. The weights pivot outwardly as the speed of rotation of the shaft increases, and during such outward movement impart axial movement to a sleeve 19. The sleeve 19 in turn imparts axial movement to a further sleeve 20 through the intermediary of a roller thrust bearing 21. There is also provided on the shaft, a further sleeve 22, and interposed between the sleeves 20 and 22 is a coiled compression spring 23. The extent of compression of the coiled compression spring 23 is limited by the abutment of an annular flange **22*a* on the sleeve 22 with the end face 20*a* of the sleeve 20**.

The flange **20*a* on the sleeve 22 engages with the curved end of a main governor spring 24. This is a leaf spring of bifurcated construction and at its end remote from the sleeve 22 it is looped around a fixed pivot 25 extending across the end closure 11. Also associated with the leaf spring is an adjustor which comprises an angularly movable plate 26 pivoted about the pivot 25 and mounting a pin 27 which engages the leaf spring intermediate its ends. The position of the plate 26 and therefore the force which is exerted by the, spring is determined by an adjustable stop 28 operable from the exterior of the end closure 11**.

The arrangement of the apparatus so far described is that with increasing speed, the weights 18 will move outwardly and will firstly effect compression of the spring 23. When the annular flange **22*a* on the sleeve 22 engages with the end face 20*a* of the sleeve 20, deflection of the spring 24** will then take place.

Figure 1:
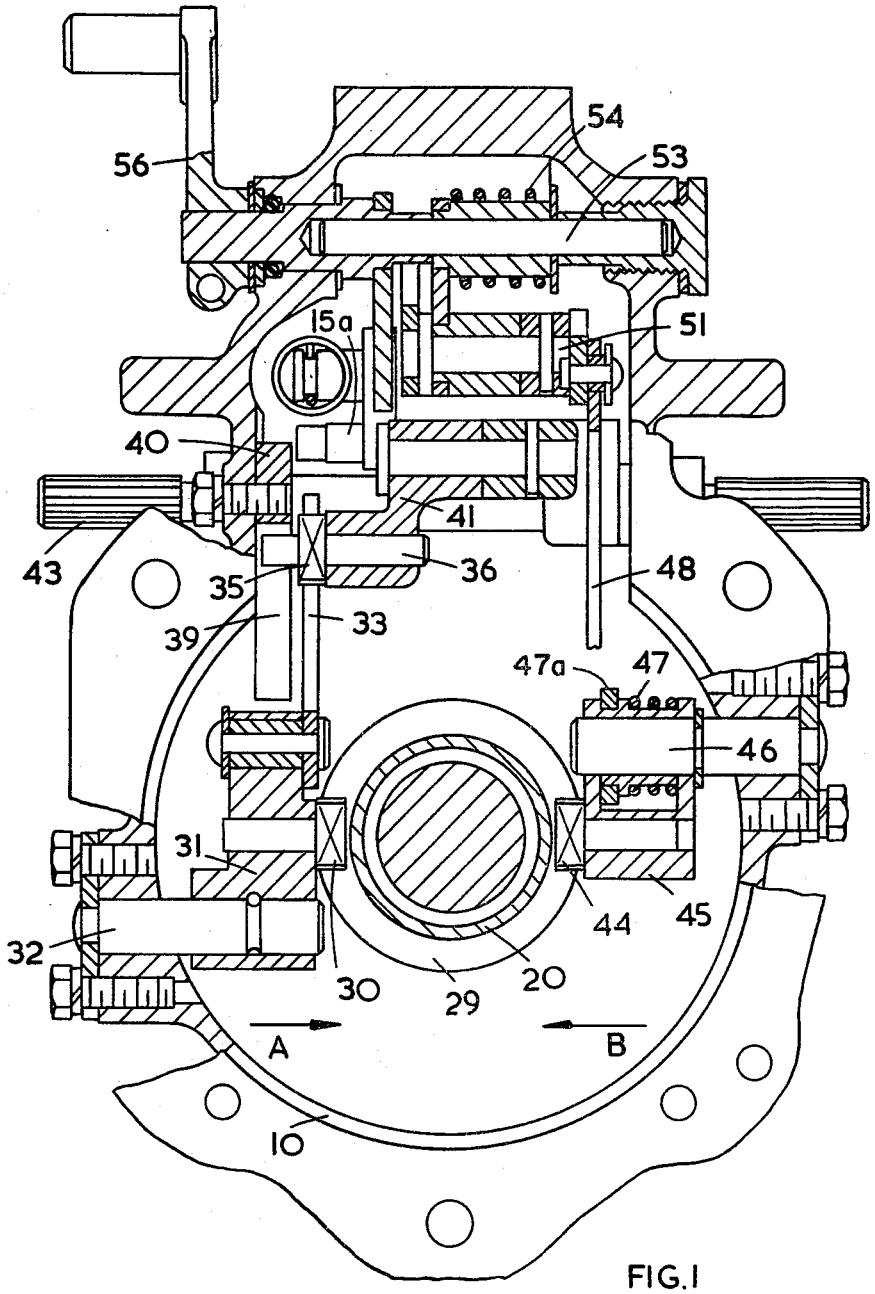
FIG. 1 is a sectional end elevation of the apparatus.

The sleeve 20 is provided with a peripheral groove 29 in which is located as seen in FIGS. 1 and 3, a slipper 30. The slipper 30 is pivotally mounted upon a first link 31 which is pivotally mounted about an axis defined by a pin 32 which is secured to the housing 10. At its other end the link 31 is pivotally connected to one end of a second link 33. The link 33 has a pair of limbs which define a slot 34, and positioned within this slot is a slidable block 35 (FIGS. 1 and 3) carried by a pin 36. The block 35 and pin 36 effectively form a pivot for the second link 33. One of the limbs of the link 33 extends upwardly and is engaged by an abutment pin **15*a* mounted on an extension of the control rod 15. This limb is urged into engagement with the pin 15*a* by means of a coiled tension spring 37 having its end remote from the limb extending around a pin carried by a plate 38** mounted on the control rod.

The pin 36 is constrained to move in a slot 39 formed in a guide plate 40. The guide plate 40 is fixed to the housing 10 of the apparatus. As seen in FIG. 3 the pin 36 is at the closed end of the slot 39 and this represents a position of minimum demanded speed. As the pin 36 is moved downwardly by means to be described, the link 33 will pivot about its pivotal connection with the link 31 and the control rod will be moved towards the left. Such movement effects an increase in the quantity of fuel supplied at each injection stroke of the injection pump. If for instance the pin 36 is positioned intermediate the ends of the slot 39, then as the speed of the associated engine increases, the link 31 will be moved in the anti-clockwise direction as seen in FIG. 3, by the governor weights, and such movement will impart clockwise movement to the link 33 about the pivot defined by the pin 36. This will effect a reduction in the amount of fuel supplied at each injection stroke.

Figure 2:
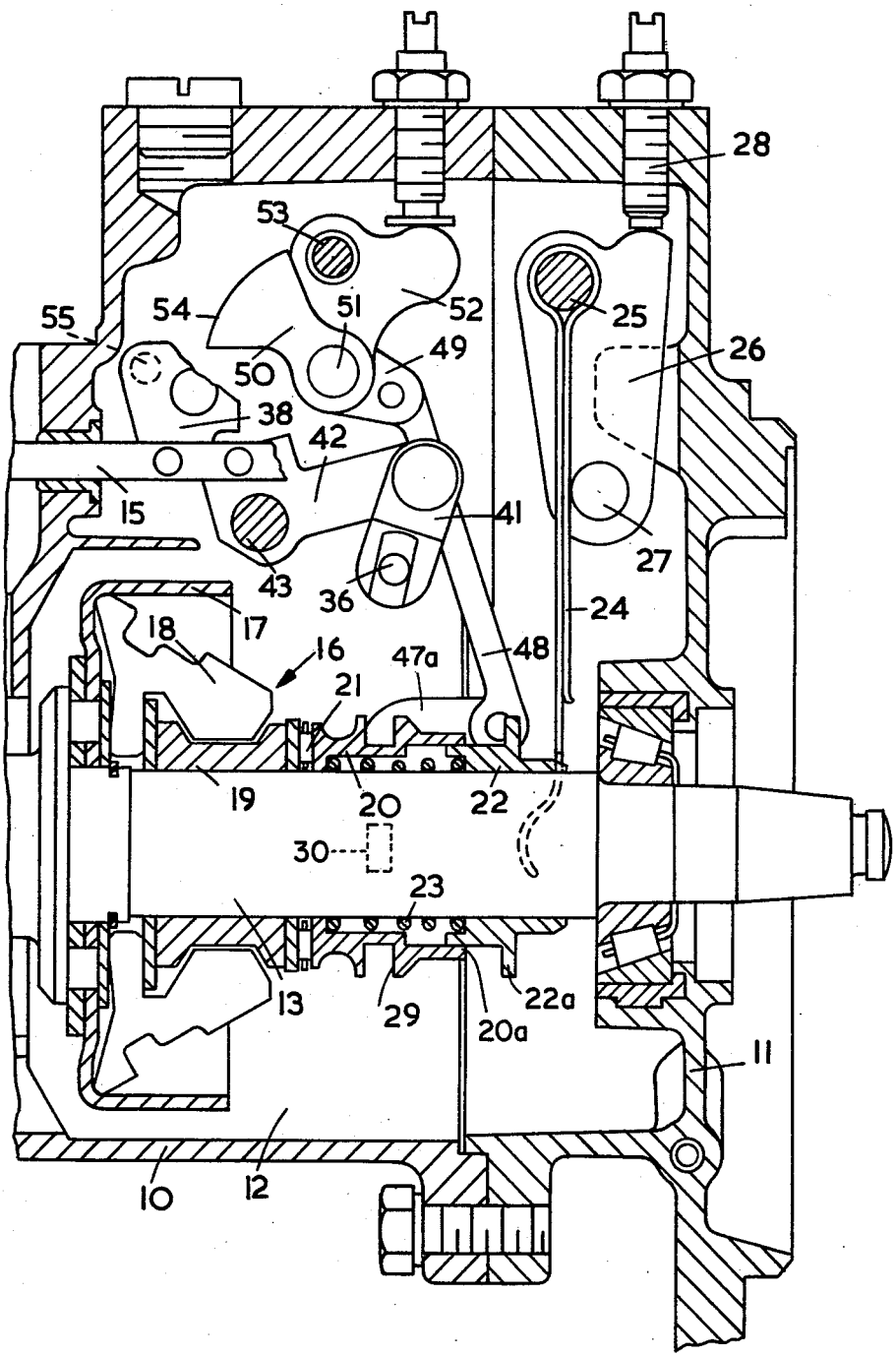
FIG. 2 is a sectional side elevation looking in the direction of the arrow A in FIG. 1.

As seen in FIGS. 1 and 2, the pin 36 is pivotally mounted within an arm 41 which is itself pivotally mounted at the end of a further arm 42. This arm is mounted about an angularly adjustable shaft 43 extending to the exterior of the housing and adapted for connection to an operator adjustable member, for instance the throttle pedal of the vehicle which is driven by the engine. As seen in FIG. 2, clockwise movement of the shaft 43 and arm 42 will effect movement of the pin 36 downwardly in the slot 39. In this manner the effective pivot point of the link 33 can be adjusted and substantially no reaction from the governor weights 18 and the spring 24 will be observed by the driver of the vehicle. Movement of the pin 36 downwardly in the slot 39 will result in movement of the control rod towards the left as seen in FIG. 3 and therefore an increase in the amount of fuel supplied to the associated engine will be obtained.

In order to provide for adjustment of the maximum amount of fuel which can be supplied to the engine relative to engine speed, such adjustment, in the art, being termed torque control, a mechanism is provided in the chamber 12 and this will now be described. With reference to FIGS. 1 and 2, a further slipper 44 (FIG. 1) is provided and which runs within the groove 29. The slipper 44 is pivotally carried in a mounting 45 which is pivotally mounted about a pivot pin 46 carried by the wall of the housing 10. The mounting 45 is coupled through the intermediary of a coiled torsion spring 47 and a further link **47*a* to a link 48. The link 48 is pivotally connected at its other end to an arm 49. This in turn is coupled to an arm 50, the axis of angular movement of the arms 49 and 50 being defined by a pin 51 carried by an angularly adjustable plate 52 (see particularly FIG. 2). The setting of the plate 52 is adjustable from the exterior of the housing and the plate is pivotally mounted about a shaft 53. A coiled torsion spring 54*a*** is provided to maintain the plate in engagement with the adjustable stop.

The remote end of the arm 50 from the pin 51 defines a cam surface 54 which can be engaged by a pin 55 projecting laterally from the plate 38. The pin 55 in conjunction with the cam surface 54, constitutes the maximum fuel stop, and the extent of movement of the control rod 15 towards the right, as seen in FIG. 2, is limited by the abutment of the pin 55 with the cam surface 54. As seen in FIG. 2, the cam surface 54 is not in a position to intercept the pin 55, and therefore angular movement of the operator adjustable shaft 43 will effect axial movement of the control rod 15 to a position in which excess fuel is obtained for starting purposes. As soon as the engine starts, the governor weights 18 move outwardly and displace the sleeve 20 against the action of the relatively light spring 23. This movement is transmitted through the link 48 and the arm 54 is moved angularly in an anti-clockwise direction as seen in FIG. 2. At the same time however the control rod is moved towards the left by the action of the links 30 and 33 so that the pin 55 clears the arm 54 so that it can act in conjunction with the cam surface 54, as the maximum fuel stop of the apparatus. The profile of the cam surface 54 is shaped to provide varying maximum fuel as the engine speed varies.

Means not shown is provided to adjust the relative disposition of the link 48 and the mounting 45.

Figure 4:
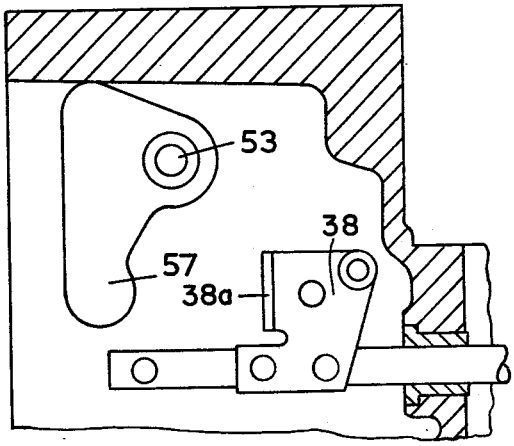
FIG. 4 is a view similar to FIG. 3 illustrating only a portion of the apparatus which is seen in FIG. 3, FIGS. 5, 6 and 7 show a modification to the apparatus shown in the preceding drawings.

The shaft 53 is angularly movable from the exterior of the housing by means of a lever 56. The shaft carries a stop plate 57 (FIG. 4) which can be moved to a position to engage with a projection **38*a* on the plate 38 thereby to move the control rod towards the minimum or zero fuel position. During such movement the tension spring 37 is stressed and allows relative movement of the link 33 and the control rod 15**.

In some apparatus of the type described the force required to move the control rod 15 is well within the range of forces which can be provided by the weights 18. In other apparatus the force required may be much higher. It is not always practical to modify the governor weights to provide the increased force since this must also require modification of the various springs. Moreover, if this force should vary during operation of the apparatus it would influence the position of the governor weights and thereby influence the operation of the weights. In order to overcome this difficulty a servo system is provided and this will now be described with reference to FIGS. 5, 6 and 7.

Figure 6:
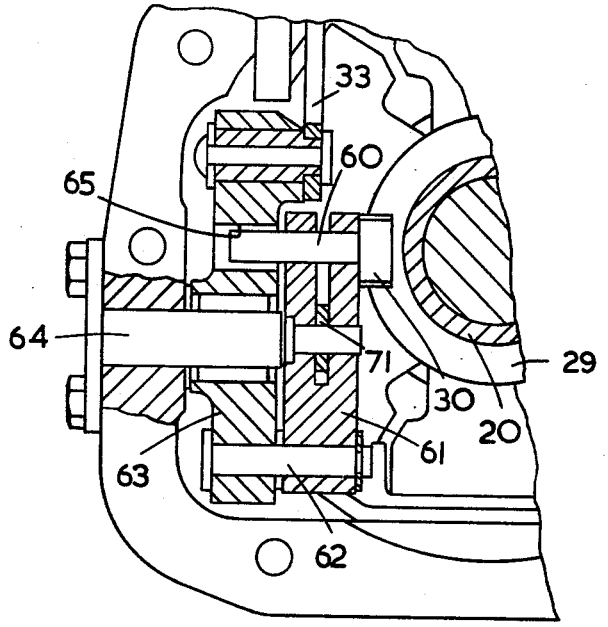

As shown in FIG. 6 the pad 30 is carried by a pin 60 which is mounted in a slipper or lever 61. The lever 61 is pivotally mounted about a pin 62 and this is carried by a rocker member 63. The rocker member 63 is the equivalent of the first lever 31 and is coupled to the second lever 33. The rocker member 63 is mounted upon a bearing carried by a pin 64 secured to the housing and the pins 60 and 62 are diametrically disposed relative to the axis of the pin 64. Moreover, the pin 60 has an extension which passes with clearance into an aperture 65 formed in the rocker member 63. In operation movement of the sleeve 20 and therefore the pad 30, will effect angular movement of the lever 61 about the pin 62 until the clearance between the pin 60 and the wall of the aperture 65 is taken up whereafter angular movement of the rocker member 63 will occur and the apparatus will function as described to prevent overspeed of the engine in the event of failure of the servo now to be described occurs.

Figure 5:
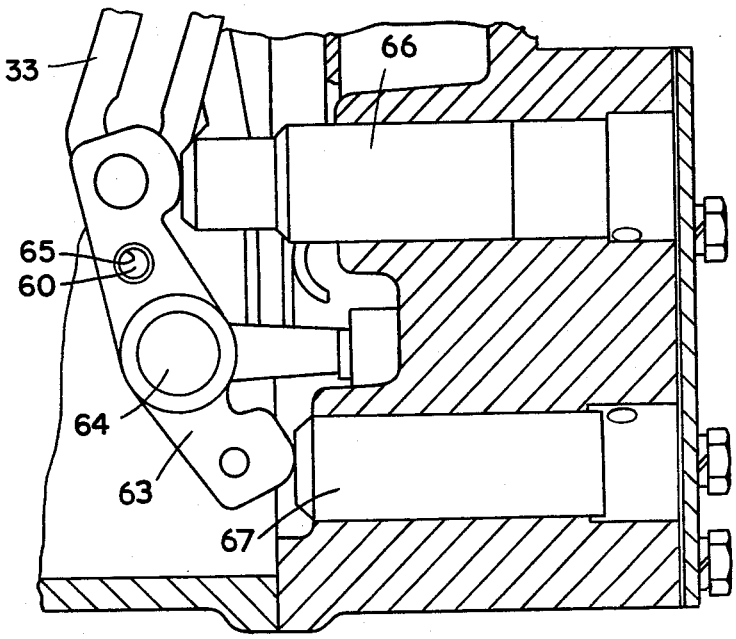

The servo comprises a pair of pistons 66, 67 which are housed within respective cylinders defined in a special end cover for the housing. The axes of movement of the pistons are substantially parallel to each other and are spaced so that the pistons engage with the rocker member 63 on opposite sides of the pivot axis defined by the pin 64 as seen in FIG. 5. A servo valve indicated at 68 (FIG. 7) controls the operation of the pistons and it will be noted that piston 66 has a larger diameter than piston 67.

Figure 7:
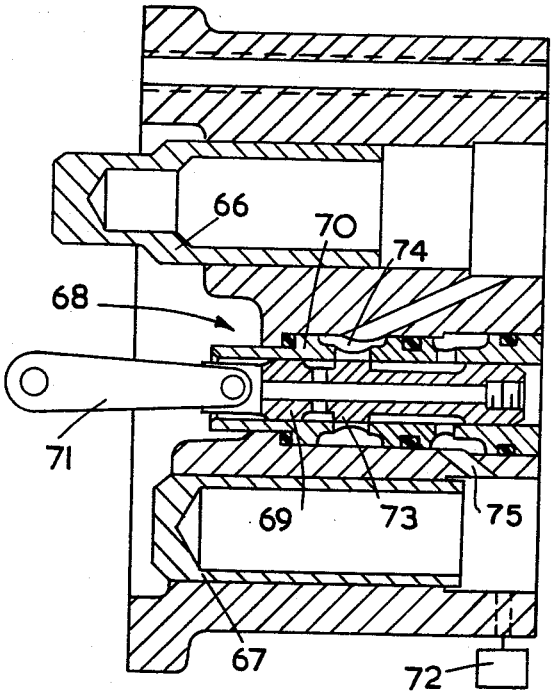

The servo valve 68 includes a valve element 69 slidable within a sleeve 70 and the valve element 69 is connected by a link 71 to the lever 61. The cylinder containing the piston 67 is in constant communication with a source 72 of fluid conveniently fuel, at a substantially constant pressure. The valve element is provided with a central land 73 which in the equilibrium position of the valve (as shown) closes a port 74 formed in the sleeve and communicating with the cylinder containing the piston 66. A groove on one side of the land, the left side as seen in FIG. 7 communicates with a central drilling in the valve element and this in turn is open at one end to the chamber. The groove on the other side of the land 73 communicates with the cylinder containing the piston 67 by way of a port 75 formed in the sleeve 70.

In operation the piston 67 will apply a substantially constant force to the rocker member 63 and in the equilibrium position with the land 73 covering the port 74, an hydraulic lock is created in the cylinder containing the piston 66. As a result no movement of the rocker member 63 will occur. If the valve element is moved towards the left the cylinder containing the piston 66 will be supplied with fuel under pressure and since the piston 66 has a larger area than the piston 67 the force generated will move the rocker member 63 in the anticlockwise direction. Conversely if the valve element 69 is moved towards the right fuel will be allowed to escape from the cylinder containing the piston 66 and the rocker member will move in the clockwise direction. The movement of the valve element 70 is controlled by the pad 30 and if this is moved by the sleeve 20, the lever 61 will pivot about the pin 62 to effect movement of the link 71 in one or the other direction. This of course will result in movement of the rocker member in the appropriate direction and in effect the pin 62 is moved about the axis defined by the pin 64. The lever 61 therefore pivots about an axis defined by the pin 60 and the valve element 70 is restored to the equilibrium position. As previously mentioned should the servo-mechanism fail the extension of the pin 60 will effect movement of the rocker member to minimise the risk of overspeeding of the engine.

In certain circumstances with the mechanism described sudden movement of the operator controlled lever can result in the parts of the governor mechanism being subjected to excessive strain. Such an occasion can arise when the engine is accelerated from idling to some higher speed. The strain in this situation can be avoided by providing a spring break mechanism in the connection between the arm 42 and the pin 36. The second situation where strain can arise is where the engine is running at high speed with no depression of the throttle pedal. In this situation the control rod 15 is forced into the minimum or zero fuel position. The strain can be avoided by providing a further spring break mechanism between the control rod 15 and the lever 33.

I claim:

1. A fuel injection pumping apparatus for supplying fuel to an associated internal combustion engine, comprising an injection pump having an axially movable control rod for determining the amount of fuel delivered by the injection pump at each injection stroke, governor means comprising a first pivotal link mounted about a fixed axis, a second pivotal link pivotally connected at one end to the first link at a position removed from said fixed axis, a slot defined in said second link, pivot means located in said slot, operator-adjustable means for adjusting the position of said pivot means within said slot, said second link being operatively connected at its other end to said control rod, a spring biased weight mechanism responsive to the speed of the associated engine, a servo-mechanism for effecting movement of the said first link about said fixed axis, an operating member for the servo-mechanism, means coupling said operating member to said weight mechanism so that movement of the weight mechanism with increasing speed will effect, through the servo-mechanism, movement of said first link in a direction to reduce the fuel supply to the engine and vice versa, said servo-mechanism acts to isolate the weight mechanism from forces acting on the control rod.

2. An apparatus according to claim 1 in which said first link is in the form of a rockable member mounted about said fixed axis, said rockable member having a pair of arms, one of which is pivotally connected to said second link, a lever pivotally mounted at one end on the other of said arms, a pad mounted at the other end of said lever and engageable with a member the position of which is determined by said weight mechanism, said servo-mechanism comprising a pair of pistons located within respective cylinders, said pistons engaging the arms respectively of said rockable member, and valve means controlling the operation of said pistons, said valve means including a valve element operably connected to said lever so that movement of the lever by weight mechanism will cause corresponding movement of said rockable member, the movement of said lever resulting in movement of said element to an equilibrium position.

3. An apparatus according to claim 2 including a pin mounting said pad on said lever, said pin having an extension located within an enlarged aperture in said rockable member whereby in the event of malfunction of the pistons or valve means or the failure of the fluid pressure controlled by the valve means, the rockable member can be moved directly by the weight mechanism.

4. An apparatus according to claim 3 in which one of the said pistons is smaller in area than the other, the cylinder containing said smaller piston being in constant communication with a source of fluid pressure, said valve means controlling the admission of fluid under pressure from said source to the other cylinder and also controlling the escape of fluid from said other cylinder.

5. An apparatus according to claim 1 including stop means for limiting the maximum amount of fuel which can be supplied to the engine, said stop means comprising a contoured surface defined upon an angularly movable member, a part carried by said control rod being engageable with said contoured surface, and linkage means connecting said angularly movable member directly with said weight mechanism whereby the position of said angularly movable member and therefore the maximum amount of fuel which can be supplied to the engine will be determined directly by the engine speed.

6. An apparatus according to claim 5 in which said angularly movable member when the engine is at rest occupies a position such that the control rod can be moved by the operator adjustable member to a position in which an excess of fuel is supplied by the apparatus for starting purposes.

* * * * *